US005233571A

United States Patent [19]

Wirtschafter

[11] Patent Number: 5,233,571

[45] Date of Patent: Aug. 3, 1993

[54] MEDICATION TIMER

[75] Inventor: Jonathan D. Wirtschafter, Minneapolis, Minn.

[73] Assignee: Mediminder Development, L.P., Minneapolis, Minn.

[21] Appl. No.: 884,933

[22] Filed: May 18, 1992

[51] Int. Cl.[5] ..... G04B 47/00

[52] U.S. Cl. ..... 368/10; 368/107

[58] Field of Search ..... 368/10, 107–113; 221/2, 3, 15; 340/309.15, 309.4; 364/569

[56] References Cited

U.S. PATENT DOCUMENTS 4,361,408 11/1982 Wirtschafter ..... 368/10
4,448,541 5/1984 Wirtschafter ..... 368/10
4,939,705 7/1990 Hamilton et al. ..... 368/10

*Primary Examiner*—Bernard Roskoski
*Attorney, Agent, or Firm*—Henderson & Sturm

[57] ABSTRACT

An improved medication timer which encourages economic efficiency by providing an inexpensive restart switch that is useable and reliable with both child-resistant or non-child-resistant medication containers. This apparatus includes a timing-and-alarm unit, an automatic time-measurement restart switch compression switch external to the inner (medication-containing) compartment, and a two-element medication closure with an inner cap element providing the physical and chemical closure and the outer sleeve element providing a means for engaging the inner cap element, retaining the timing-and-alarm unit, and activating the automatic time-measurement restart switch compression switch.

10 Claims, 1 Drawing Sheet

MEDICATION TIMER

TECHNICAL FIELD

This invention generally relates to timers and more particularly to medication timer mechanisms.

BACKGROUND ART

Most drugs and medications currently prescribed by physicians or sold without prescription require periodic administration at specified times. If the patient errs and repeats the doses too frequently, an overdose may result. Similarly, if the patient should fail to administer the medication at the proper time intervals, the concentration of the medication in the patient's body may become too low.

Therefore, certain time keeping responsibilities are clearly imposed when taking a medication. This time keeping responsibility falls of necessity upon either the patient or those who take care of him or her. With regard to the later, the problems are aggravated if more than one person cares for the patient, such as in a family or institutional setting. The multiple attendants must accurately communicate with one another or confusion may result as to when medication should again be administered. This situation may lead to under or over dosage of the medication.

Perhaps most commonly, the patient will note the current time on a watch or other standard time keeping device. On the basis of the physician's instructions regarding the minimum and maximum safe intervals between doses, the time of the next administration should be governed on the basis of the time as committed to memory or recorded in some other way. A number of disadvantages become apparent with the prior art methods as the time of the prior administration may not have been observed, recorded, or communicated correctly leading to errors in the use of medications. These problems become particularly acute in patients whose mental or physical condition makes them less capable of reliably discharging such actions, or as mentioned above, where a number of persons are responsible for the patient.

Other suggested solutions to this problem are found in the prior art. A number of devices are designed to either minimize or reduce the mental calculation involved and/or operate as reminder devices. Some of these devices comprise a small pill case having a timer and alarm built into it such that when the alarm sounds, the patient will be alerted and hopefully act in accordance with the instructions provided by the physicians prescriptions.

Often, however, the patient should not use such a reusable pill container, timer and alarm. For instance, it may be impossible (as with liquids), inconvenient or improper to transfer medication from the primary container to such an integral pill box. More importantly, some medications are not suitable for use with reusable pill containers due to accumulated toxicity problems.

Perhaps more fundamental, these devices only act as simple alarm clocks that include the sometimes convenient feature of positioning the medication in close proximity to the clock. Other than sounding the alarm, however, no provisions are made to ensure or urge compliance with the medication schedule. The user can simply cut off the alarm and never take any further steps toward administering the medication, either through intentional or unintentional neglect, thereby risking an underdose condition. Further, if the user does take the medication on schedule, he or she may still neglect to restart the timing function, and thereby risk an overdoes condition.

U.S. Pat. No. 4,448,541 discloses a magnetically responsive switch for resetting the timing measurement function that is suitable for both integral and non-integral medication containers. U.S. Pat. No. 4,361,408 discloses a compression contact switch strapped to the outside of a medication container. A number of digital medication timing devices have been produced with automatic resetting compression switches located within the cap closure all arranged to detect the removal or full replacement of the cap on a screw-cap medication container. Some of these are designed to function on child-resistant containers that require the presumed strength and skill of a competent adult to operate.

Certain difficulties are inherent in the prior art in that these cap contained devices with automatic reset switches may (1) breach the physical and chemical security of the inner (medication-containing) compartment of the medication cap closure in order to introduce the wires for the electrical switch contact circuits, (2) may interfere with the function of the child-resistant mechanisms that are used to prevent unintended opening and thus also cause problems with the proper operation and safety of such mechanisms, (3) require that each version or batch of the cap closures be tested to demonstrate its compliance with child-resistant regulations of each government, and (4) cost more to produce in multiple cap closure sizes each with its own physical production requirements.

In view of the above, the prior art lacks a medical timer device suitable for use with child-resistant and non-child-resistant medication containers and that further contains an automatic time-measurement restart switch mechanism external to the inner (medication-containing) compartment that responds to some parameter of medication cap closure position indicative of compliance, thus encouraging compliance with the instructions for the use of medication.

Those concerned with these and other problems recognize the need for an improved medical timer.

DISCLOSURE OF THE INVENTION

The present invention comprises an improved medication timer which encourages economic efficiency by providing an inexpensive restart switch that is useable and reliable with both child-resistant or non-child-resistant medication containers. This apparatus includes a timing-and-alarm unit, an automatic time-measurement restart switch compression switch external to the inner (medication-containing) compartment, and a two-element medication closure with an inner cap element providing the physical and chemical closure and the outer sleeve element providing a means for engaging the inner cap element, retaining the timing-and-alarm unit, and activating the automatic time-measurement restart switch compression switch.

The timing-and-alarm unit may be comprised of any suitable mechanism that includes a timing unit and an alarm unit for setting and activating an alarm in response to time or to a pre-set time interval between doses. The alarm and timing apparatus can be constructed as a single unit.

The compression restart switch may be configured in a normally closed or a normally open posture and may be connected with a digital timing-and-alarm unit's timing restart mechanism and with the alarm-termination mechanism. Operation of the switch can permit either or both the restarting to the measured time and the squelching of the alarm.

The inner cap element of the medication timer may be of any type in general use, such as a screw cap or notch cap with a soft-compressible inner seal. Such caps are usually opaque and have some system of detents on their surface that provide a means for engaging the outer sleeve element for the child resistant feature. In the instant invention, the design of the inner cap element need not be modified at all or the top surface may be modified to provide indents or ridges to stabilize or prevent rotation of the alarm-and-timing apparatus between the inner cap and outer sleeve elements of the medication timer.

The outer sleeve element of the medication timer may be of any type in general use except that its configuration must be modified (1) to permit the placement of the alarm-and-timing apparatus and switch between the inner cap and outer sleeve elements, (2) to be transparent or have a transparent window that permits viewing of the digital display of the timing apparatus, and (3) to have one or more holes or other openings that permit access to the timing-and-alarm apparatus setting switches (not the automatic reset switch described above) that may be on the top or sides of the alarm-and-timing apparatus. The outer sleeve element would retain its means of engagement of the inner cap element.

When the patient grips the closure to compress and turn it in an effort to open the cap to remove the medication, the pressure exerted by the user's hands will compress the spring on the automatic reset switch, and hence cause the switch to operate and to restart the measurement of time and/or to terminate the alarm function.

Such a timing-and-alarm unit may be used with child-resistant and non-child-resistant containers by varying design so that less pressure is required to open the non-child-resistant closure.

The timing apparatus may be constructed so as to freeze the display for a period (for example, 30 seconds) to allow the user to read the unreset display while not being annoyed or distracted by the sound of an alarm.

The outer sleeve element of the closure may be rotated by the user to allow alignment of any hole or holes provided that allow both access to and protection of the switch or switches that set the timing-and-alarm apparatus. The outer sleeve element also provides a way to secure the timer to the medication cap and container. The user may place the device in a purse or pocket or similar location with reasonable security that the outer sleeve element of the cap provides reasonable security against accidental compression of the set or reset switches.

The integration of the switch within the timing-and-alarm apparatus of a single size may allow the apparatus to be used with a variety of sizes of containers, requiring only a modification of the caps of different sizes to fit the one size of timing-and-alarm apparatus. This results in concurrent savings of material and contributes to the reliability of the device for numerous reasons including the security of an unbreached inner cap element and the preservation of any child-resistant features of each cap design.

An object of the present invention is the provision of an improved medical timer.

BRIEF DESCRIPTION OF THE DRAWINGS

These and other attributes of the invention will become more apparent upon a thorough review of the following description of the best mode for carrying out the invention, particularly when reviewed in conjunction with the drawings, wherein.

BEST MODE FOR CARRYING OUT THE INVENTION

Figure 1:
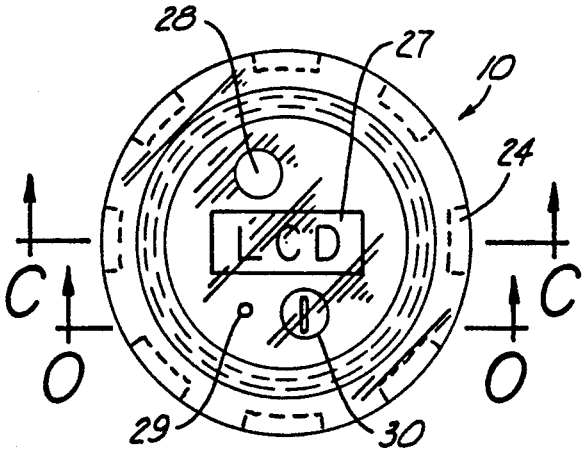
FIG. 1 is a top plan view of the device of the present invention not attached to a medication container.
Figure 4:
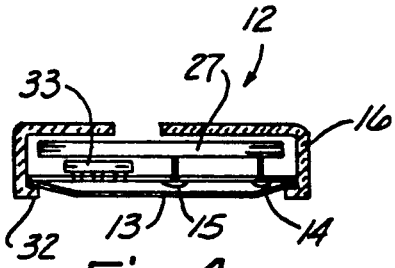
FIG. 4 is a side elevation sectional view taken along line C—C of FIG. 1 showing the timing-and-alarm unit and the reset switch removed from the outer portion of the cap closure.

Referring now to the drawings, wherein like reference numerals designate identical or corresponding parts throughout the several views, FIG. 1 shows the medical timer (10) of the present invention comprising the timing-and-alarm unit (12) configured integral to the medication closure cap (11). The inner cap (17) and the outer sleeve (18) without the integral time-and-alarm unit (12) may be seen in FIG. 2. More particularly, the invention includes generally a timing-and-alarm unit (12) and an automatic resetting switch comprised of a metallic conductive spring (13) operatively connected to contacts (14) and (15) on the bottom surface of the case (16) of the integral timing-and-alarm unit (12) (FIG. 4). These general components will now be described in seriatim fashion.

Figure 2:
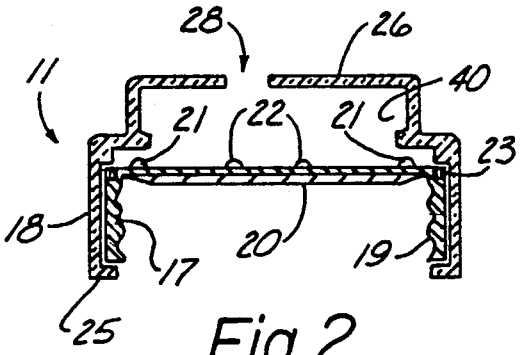
FIG. 2 is a side elevational sectional view of the device taken along line C—C of FIG. 1 with the timing-and-alarm and reset switch unit removed to show the inner cap and outer sleeve portions of the medication cap closure.
Figure 3:
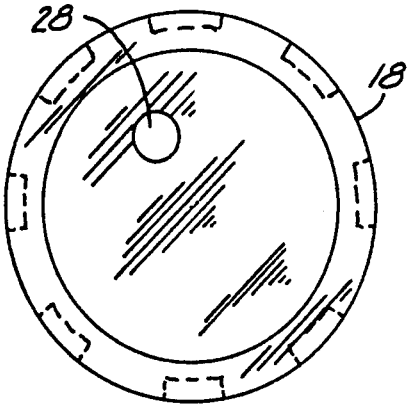
FIG. 3 is a top plan view of the device as shown in FIG. 1 with the timing-and-alarm and reset switch unit removed showing the outer portion of the medication cap.
Figure 6:
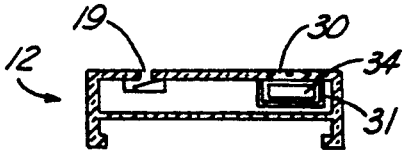
FIG. 6 is a side elevational view of the timing-and-alarm unit and the reset switch taken along line O—O of FIG. 1 showing the setting switches and removable battery compartments.

Referring now to FIGS. 1, 2, and 3, the inner cap (17) and outer sleeve (18) of the medication timer (10) may be provided by the caps manufactured by Owens-Illinois. The inner cap element (17) is opaque and contains a screw thread (19) that fits the top of a compatible medication container (not shown). It is sealed with a compressible seal (20) that provides physical and chemical protection for the medications. This inner cap portion (17) need not be altered in any way for the instant invention to operate although the provision of a circular ridge (21) could additionally stabilize the alarm-and-timing unit (12) or a detent or depression (22) could stabilize the unit or the reset switch spring (13). The inner cap (17) also contains multiple (typically more than 6) posts (23) along its upper circumference. Each of these is slanted on one edge so that the user rotating the outer sleeve element (18) must apply downward pressure in order to keep the outer sleeve element (18) engaged with the inner cap element (17) to turn threaded inner cap (17) and open the medicine container. The outer sleeve element (18) has rectangular posts (24) at the same spacing along its inner, upper circumference that are made to alternatively slide on or turn the inner cap element (17). This feature provides the child-resistance. The outer sleeve element (18) also contains lower lip (25) that prevents its inadvertent separation from the inner cap portion (17). The instant invention modifies the outer cap element (18) by raising its central portion so that it has a compartment (40) to contain the timing-and-alarm apparatus (12). The amount of elevation must be sufficient that the spring (13) is not compressed when the sleeve (18) is not intentionally depressed and sufficient to ensure its compression with the sleeve 18 is depressed to engage the inner cap (17) to remove the medication. The range of the elevation must be approximately the height of the timing-and-alarm unit (12). The outer sleeve element (18) must be transparent or have a transparent window to permit viewing of the display (27) of the timer-and-alarm apparatus (12). The outer sleeve element (18) must also have one or more holes (28) to permit setting of the timer-and-alarm apparatus switch (29) or access to the cover (30) of a replaceable battery compartment (31) (FIG. 6).

Figure 5:
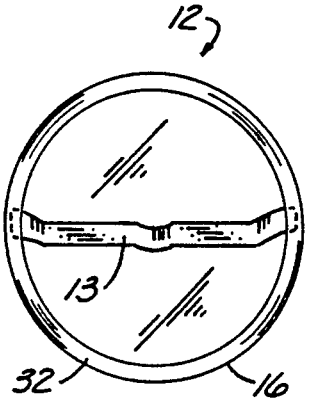
FIG. 5 is a bottom plan view of the timing-and-alarm unit and the reset switch of FIG. 4.

Referring now to FIG. 5, the metallic compression spring (13) is at the bottom of the case (16) of the timer-and-alarm apparatus (12). The spring's configuration of length, bend, and spring properties are such that when compressed it will extend close to the limits of the spring retention lip (32) of the case (16) and when relaxed will not fall out of the retention lip (32).

Referring now to FIG. 4, the timer-and-alarm apparatus (12) may be provided by the use of a timing-and-alarm apparatus made by Tele-Art Inc. of Hong Kong for Medical Compliance Technologies Inc. This timing-and-alarm unit includes appropriate electrical circuitry (not shown) for measuring time, setting a preset time interval, and for sounding an alarm when the preset time interval has expired. The apparatus further includes a LCD readout (27) to display the elapsed time and alarm set times, an alarm transducer (33) for sounding an alarm, and set switches (29). The device is powered by a battery (34) which could be a replaceable type located in a battery compartment (31) with a removable cover (30). Compression of the spring (13) causes an operable connection closing the circuit with contacts (14) and (15). The timer circuit could be modified to freeze the time display for a preset period after switch closure to provide the user time to inspect the display and consider if it is indeed time to use the medication. The Tel-Art device could be substituted with other devices such as the device of U.S. Pat. No. 4,558,303, which patent is incorporated herein by reference.

Thus, it can be seen that at least all of the stated objectives have been achieved.

Obviously many modifications and variations of the present invention are possible in light of the above teachings. It is therefore to be understood that, within the scope of the appended claims, the invention may be practiced otherwise than as specifically described.

I claim:

1. A medication timer for use in conjunction with a medication container having a medication-containing cavity with an access opening provided with outwardly projecting securing means; wherein, the medication timer comprises:

a removable closure cap including an interior portion having inwardly projecting securing means operatively engageable with the externally projecting securing means on the access opening of the medication container, and an exterior surface an outer sleeve disposed in a surrounding relationship relative to the exterior surface of said closure cap; wherein the outer sleeve includes an interior compartment disposed above said closure cap and having an enlarged opening formed therein; wherein, said sleeve is moveable between a first depressed position wherein the compartment is moved toward the cap and a second retracted position wherein the compartment is moved away from the cap; and, a timing unit received within the enlarged opening in said compartment, the timing unit including time-measurement restart switch means activated by movement of the outer sleeve between the retracted position and the depressed position for resetting the timing unit at a predetermined time interval indicating an appropriate time interval for taking medication.

2. The timer of claim 1 wherein the timing unit includes audible alarm means for indicating the expiration of the predetermined time interval.

3. The timer of claim 1 wherein the timing unit includes visual display means for indicating the expiration of the predetermined time interval.

4. The timer of claim 2 wherein the timing unit includes visual display means for indicating the expiration of the predetermined time interval.

5. The timer of claim 4 wherein the compartment is formed of transparent material.

6. The timer of claim 4 wherein the compartment includes a viewing window disposed over the visual display means.

7. The timer of claim 1 wherein the closure cap and outer sleeve are selectively engageable and form a child-proof device.

8. The timer of claim 1 wherein the timing unit includes selection means for changing the predetermined time interval, and wherein the compartment includes access means for providing access to the selection means.

9. The timer of claim 1 wherein the timing unit includes a battery case, and wherein the compartment includes access means for providing access to the battery case.

10. The timer of claim 2 wherein the restart switch means is operably connected to deactivate the alarm.

* * * * *